US006585530B2

(12) United States Patent
Steiert et al.

(10) Patent No.: US 6,585,530 B2
(45) Date of Patent: Jul. 1, 2003

(54) PLUG-IN POWER SUPPLY WITH MINIATURIZED PRIMARY CONTACT MEANS

(75) Inventors: Thomas Steiert, Ostbevern (DE); Andreas Kniesel, Muenster (DE)

(73) Assignee: Friwo Geraetebau GmbH (DE)

( * ) Notice: Subject to any disclaimer, the term of this patent is extended or adjusted under 35 U.S.C. 154(b) by 0 days.

(21) Appl. No.: 10/051,437

(22) Filed: Jan. 18, 2002

(65) Prior Publication Data

US 2002/0160636 A1 Oct. 31, 2002

(51) Int. Cl.[7] ..... H01R 13/44; H01R 13/60
(52) U.S. Cl. ..... 439/131; 439/171
(58) Field of Search ..... 439/131, 171–174, 439/956, 640

(56) References Cited

U.S. PATENT DOCUMENTS

| | | | | | |
|---|---|---|---|---|---|
| 2,490,580 | A | * | 12/1949 | Colla, Jr. | 439/131 |
| 2,538,296 | A | * | 1/1951 | Crocker | 439/131 |
| 4,080,029 | A | * | 3/1978 | St. Fort | 439/131 |
| 4,626,052 | A | * | 12/1986 | Rumble | 439/173 |
| 5,135,406 | A | * | 8/1992 | Ishikawa | 439/131 |
| 5,611,701 | A | * | 3/1997 | Hahn | 439/131 |
| 5,628,641 | A | * | 5/1997 | Hahn | 439/131 |
| 5,901,056 | A | | 5/1999 | Hung | |
| 6,126,460 | A | * | 10/2000 | Wu | 439/131 |
| 6,190,184 | B1 | * | 2/2001 | Cimbal et al. | 439/131 |
| 6,241,538 | B1 | * | 6/2001 | Chen | 439/131 |
| 6,325,646 | B1 | * | 12/2001 | Uemura et al. | 439/131 |

FOREIGN PATENT DOCUMENTS

| | | |
|---|---|---|
| DE | 297 08 589 U1 | 9/1997 |
| DE | 198 35 161 C1 | 10/1999 |
| DE | 198 45 962 C1 | 10/1999 |

* cited by examiner

*Primary Examiner*—Lynn D. Feild
*Assistant Examiner*—Hae Moon Hyeon
(74) *Attorney, Agent, or Firm*—Michael Best & Friedrich, LLP

(57) ABSTRACT

A plug-in power supply for converting a mains voltage into an operating voltage is provided, comprising a housing having arranged therein an electronic circuit for voltage conversion, and at least two primary contact pins which are movable between an operating position, in which they are adapted to be inserted into the mains socket and in which they extend substantially at right angles to one of the lateral surfaces of the housing, and a position of rest on at least one of said lateral surfaces, the primary contact pins being arranged substantially parallel to said at least one lateral surface in said position of rest. In order to achieve the largest possible reduction of size and in order to guarantee that the plug-in power supply can be handled easily and safely, a geometric arrangement of the primary contact pins with respect to each other in their position of rest differs from a geometric arrangement of the primary contact pins in their operating position.

19 Claims, 5 Drawing Sheets

Stand der Technik

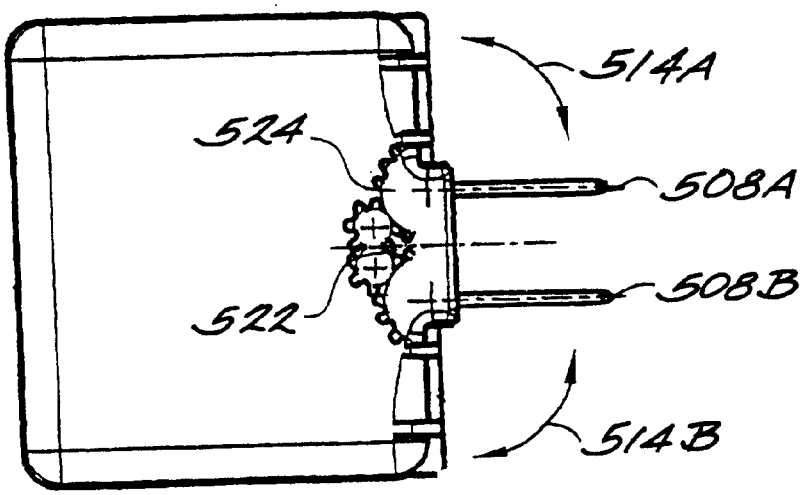
FIG.5A
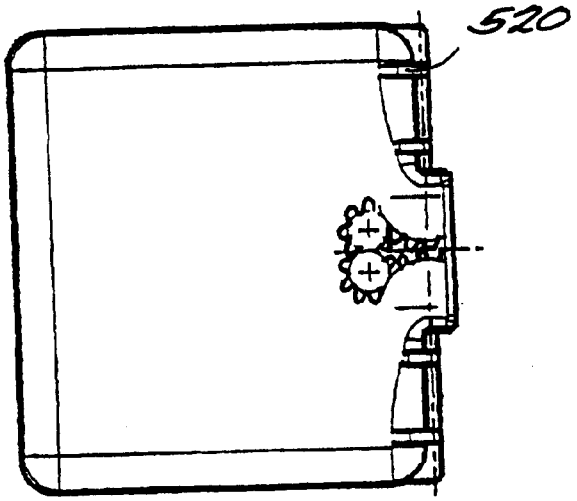
FIG.5B
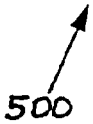

PLUG-IN POWER SUPPLY WITH MINIATURIZED PRIMARY CONTACT MEANS

BACKGROUND OF THE INVENTION

1. Field of the Invention

The present invention generally relates to DC power supplies and in particular to a plug-in power supply for converting a main supply voltage into an operating voltage, comprising a housing having arranged therein an electronic circuit for voltage conversion, and at least two primary contact pins which are movable between an operating position, in which they are adapted to be inserted into the main supply socket and in which they extend substantially at right angles to one of the lateral surfaces of the housing, and a position of rest on at least one of said lateral surfaces, the primary contact pins being arranged substantially parallel to said at least one lateral surface in said position rest.

2. Description of the Related Art

As outlined in FIG. 1, conventional plug-in power supplies, which convert the main supply voltage (normally 110 or 230 volt) into an operating voltage (normally a so-called extra-low safety voltage), comprise a housing 102 having essentially the shape of a rectangular parallelepiped and including a cover surface 110, a base surface 111, as well as four lateral surfaces 116. The housing 102 has arranged therein an electronic circuit for voltage conversion. In addition, the plug-in power supply 100 is normally provided with an electric connecting line 104 which is adapted to be inserted via a plug 106 into a plug socket of a load, and a primary contact 108 arranged on the base surface 111 and adapted to be inserted into a main supply socket. The trend towards size optimization of mobile loads, such as mobile phones, palmtops or the like, makes it necessary that also the accessories required, such as a charging set, which can be realized in the form of a plug-in power supply according to FIG. 1, are miniaturized to the greatest degree possible. In particular on the Asian market, a volume optimization of technical devices is a feature which decisively influences the buyer's decision. The reduction of size is limited by the electric components which have to be used and by the standards which have to be observed with regard to insulation distances and creeping distances. It follows that narrow limits are set to a more far-reaching miniaturization of the plug-in power supply, especially in the operating condition, as can be seen for instance from DE 198 35 161 C1 and DE 198 45 962 C1.

Such conventional plug-in power supplies are known for instance from DE 297 08 589 U1 and U.S. Pat. No. 5,901,056.

For accommodating the primary contact pins 108 on the base surface 111, a recess is provided, which extends comparatively far into the interior of the housing. This has the effect that the volume in the housing interior that can be used for the electric components is reduced by mechanical components.

A further drawback of the arrangement outlined in FIG. 1 is the disadvantageous position of the plug-in power supply 100 in a main supply socket in which neighboring sockets may be covered.

SUMMARY OF THE INVENTION

It is therefore the object of the present invention to provide a plug-in power supply for converting a main supply voltage into an operating voltage, said plug-in power supply being reduced still further in size and adapted to be handled easily and safely.

According to one embodiment, a geometric arrangement of the primary contact pins with respect to each other in their position of rest differs from a geometric arrangement of the primary contact pins in their operating position.

A substantial advantage of said plug-in power supply according to the present invention is that, by displacing the primary contact pin, said primary contact pin can be moved to an extremely space-saving position of rest. In addition, the plug-in power supply according to the present invention has a smooth surface, without any projecting plug pins which may get caught up with other components during transport, when the primary contact pin is at its position of rest. By arranging the primary contact pin at right angles to a lateral surface of the plug-in power supply in the operating position, it is additionally possible to prevent neighboring sockets from being rendered inaccessible.

In order to make the plug-in power supply compatible with existing main supply sockets, same is provided with two primary contact pins, which, when occupying the operating position, are arranged at a distance from one another that conforms to the standard.

Further developments of the present invention are the subject matters of a plurality of dependent claims.

According to a preferred embodiment, the primary contact pins are adapted to be swiveled, e.g., for the purpose of transport, from the operating position, in which they are adapted to be inserted into the main supply socket, to a position of rest on at least one of the lateral surfaces of the housing. This offers the advantage that space for the contact pin is not required in the interior of the housing. The structural design of the housing is particularly simple in the case of this embodiment.

According to another preferred embodiment, one of the primary contact pins is adapted to be axially displaced from the operating position to the position of rest on one of the lateral surfaces of the housing and the other primary contact pin is adapted to be swiveled from the operating position to the position of rest on one of the lateral surfaces of the housing. This embodiment offers the possibility of a particularly far-reaching miniaturization of the plug-in power supply, when the primary contact pins are at their position of rest and handling will be particularly easy.

In order to guarantee the highest possible safety of the plug-in power supply according to the present invention, the plug-in power supply can be so conceived that the electric connection between the primary contact pin and the electronic circuit in the interior of the housing will not be established until the final operating position has been reached.

Particularly safe contact with the main supply socket will be achieved when the primary contact pin is adapted to be locked in its operating position.

According to a preferred embodiment, the housing is provided with recesses which accommodate the primary contact pin in its position of rest. This will guarantee that the surface of the plug-in power supply according to the present invention is flat and that projecting pins which may get caught up with other components are avoided.

When the primary contact pin is so conceived that it is adapted to be locked in its position of rest, this will have the advantage that it is protected against inadvertent displacement from its position of rest.

According to a preferred embodiment, the housing of the plug-in power supply according to the present invention comprises two halves which are adapted to be connected to one another. This offers the advantage of a simplified, economy-priced assembly.

In order to guarantee an increased degree of safety, the plug-in power supply according to the present invention can be equipped with a mechanical coupling device which is provided between the two primary contact pins and which forces the two pins to move simultaneously.

A particularly simple and economy-priced possibility of realizing such a coupling device is the use of gears.

The housing can be provided with an electric connecting line which is adapted to be inserted via a plug into a plug socket of a load so that, when the plug-in power supply is in operation, a connected load can be arranged remote from the power socket (e.g. a mobile phone on a table).

BRIEF DESCRIPTION OF THE DRAWINGS

The accompanying drawings are incorporated into and form a part of the specification for the purpose of explaining the principles of the invention. The drawings are not to be construed as limiting the invention to only the illustrated and described examples of how the invention can be made and used. Further features and advantages will become apparent from the following and more particular description of the invention, as illustrated in the accompanying drawings, wherein:

FIG. 5A illustrates an operating position of a plug-in power supply according to a fourth preferred embodiment;

FIG. 5B illustrates a rest position of a plug-in power supply according to a fourth preferred embodiment.

DETAILED DESCRIPTION OF THE INVENTION

The illustrative embodiments of the present invention will be described with reference to the figure drawings wherein like elements and structures are indicated by like reference numbers.

Figure 1:
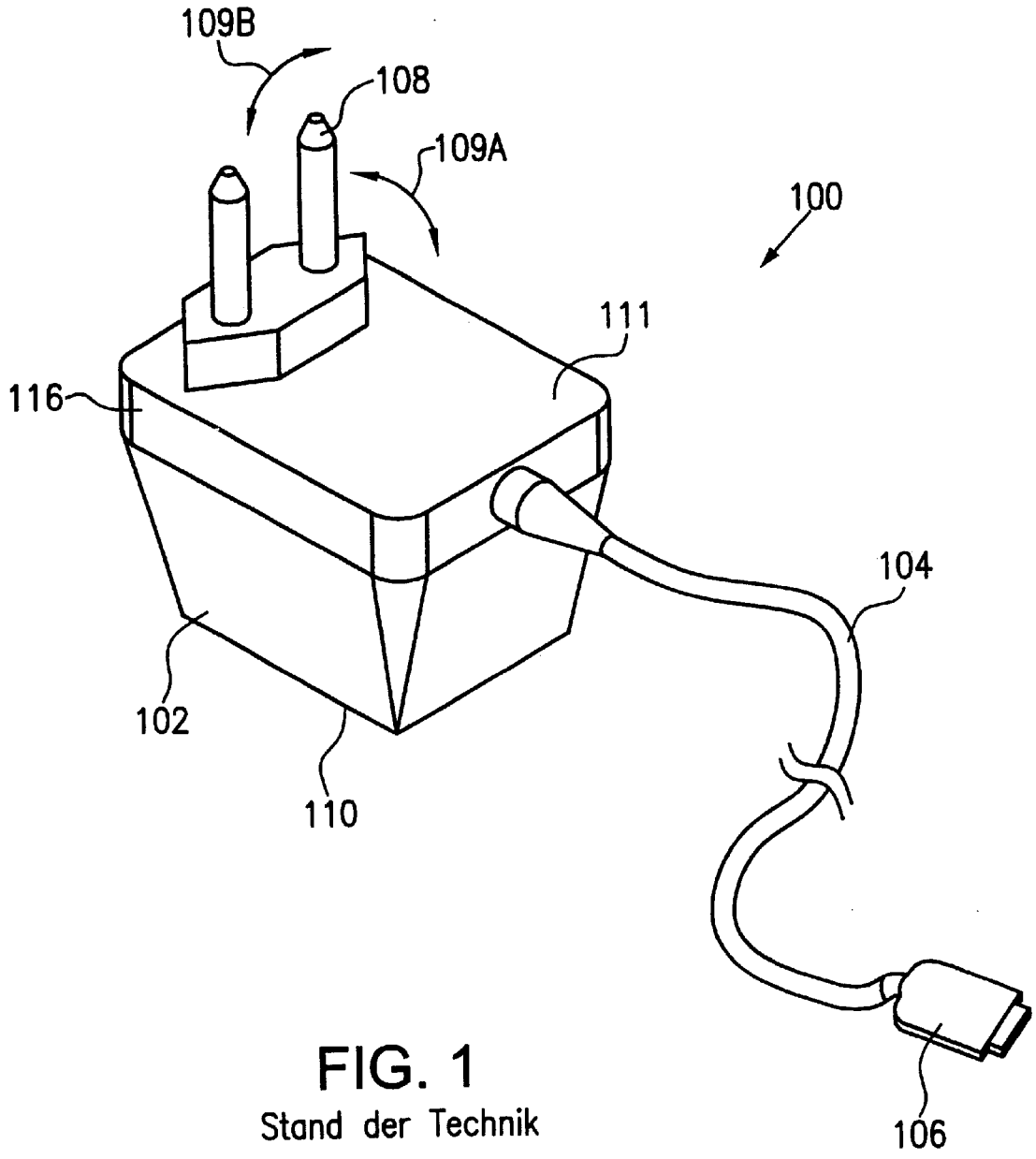
FIG. 1 illustrates a perspective view of a plug-in power supply according to the prior art.
Figure 2A:
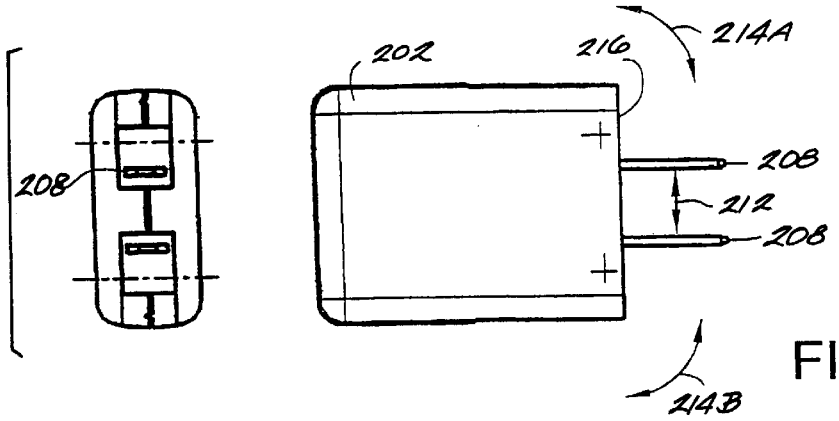
FIG. 2A illustrates an operating position of a plug-in power supply according to a first preferred embodiment.
Figure 2B:
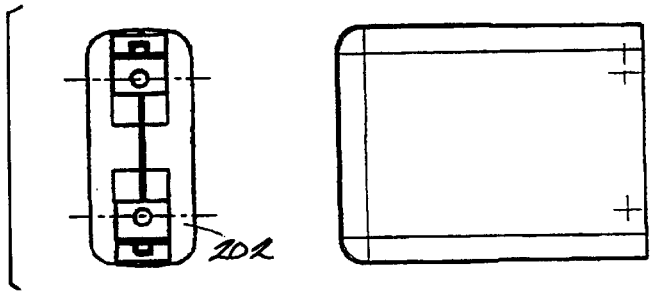
FIG. 2B illustrates a rest position of a plug-in power supply according to a first preferred embodiment.
Figure 2C:
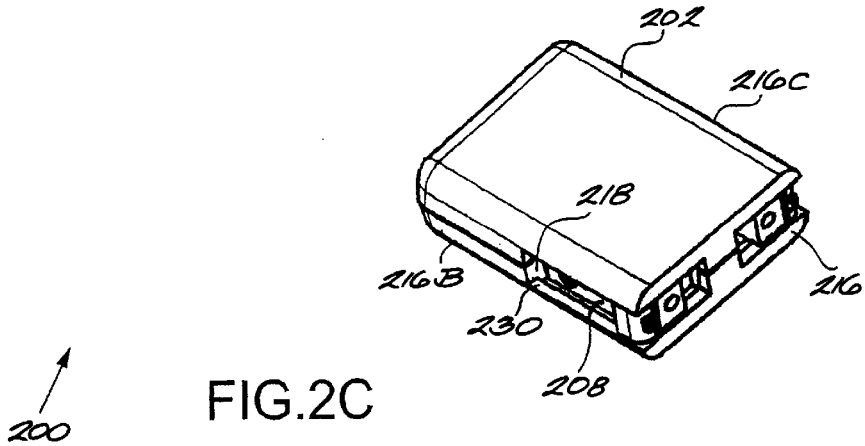
FIG. 2C illustrates a perspective view of a rest position of a plug-in power supply according to a first preferred embodiment.
Figure 3A:
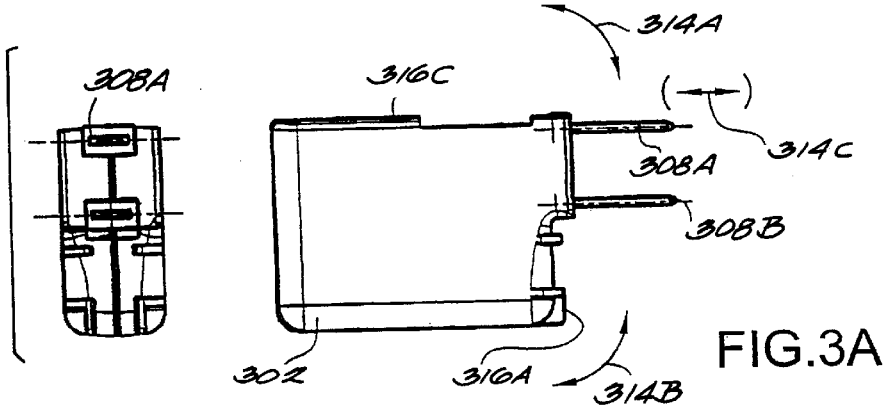
FIG. 3A illustrates an operating position of a plug-in power supply according to a second preferred embodiment.
Figure 3B:
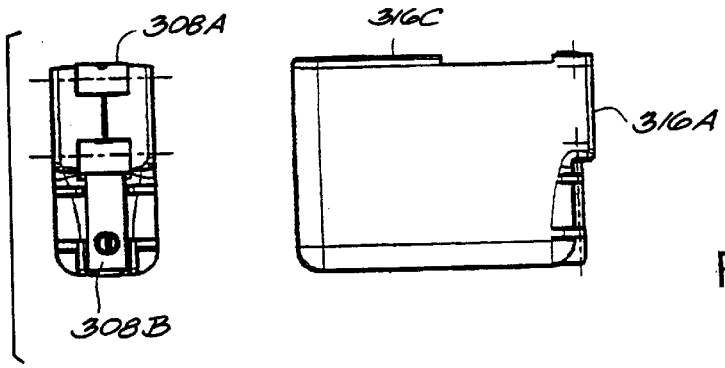
FIG. 3B illustrates a rest position of a plug-in power supply according to a second preferred embodiment.
Figure 3C:
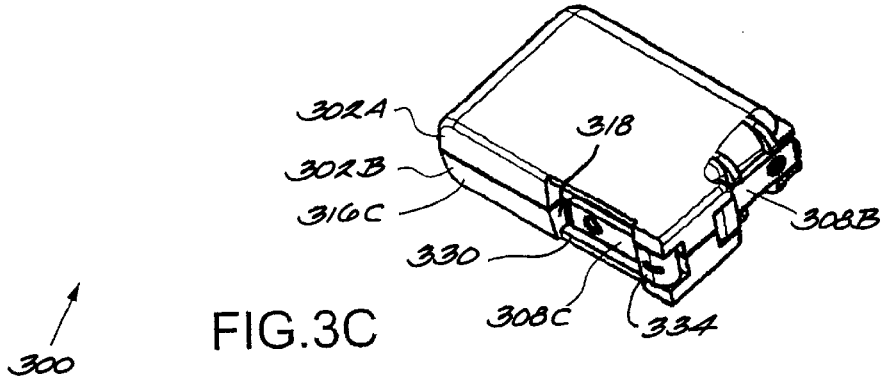
FIG. 3C illustrates a perspective view of a rest position of a plug-in power supply according to a second preferred embodiment.

As can be seen in FIGS. 2A–2C, a plug-in power supply 200 according to one embodiment comprises a housing 202 having arranged therein an electronic circuit for voltage conversion, an electric connecting line (not shown here so as to simplify the representations) which is adapted to be inserted via a plug into a plug socket of a load, and two primary contact pins 208 which are adapted to be inserted into a main supply socket. In FIG. 2A the operating position of the plug-in power supply according to the present invention is shown. The two primary contact pins 208 protrude at right angles from a lateral surface 216 of the housing 202 and can be inserted into a main supply socket in this position. The two primary contact pins 208 extend at a distance 212 from one another. This distance 212 as well as the implementation of the primary contact pins depends on the structural design of the main supply socket into which the plug-in power supply is to be inserted. The primary contact pins may, for example, have a round as well as a rectangular cross-section. In the case of the embodiment outlined in the drawing, it is additionally guaranteed that, in a connector strip having arranged therein a plurality of main supply sockets, neighboring sockets will not be covered. The primary contact pins 208 can, e.g., for the purpose of transport, be moved in directions 214A and 214B and assume a rest position on one of the lateral surfaces 216B, 216C of the housing 202. They are then located at the position of rest outlined in FIG. 2B. As can be seen from the perspective view in FIG. 2C, each of the housing sides 216B and 216C has provided therein a recess 218 which accommodates the respective primary contact pin 208. Due to the fact that the primary contact pins 208 can be embedded in the recesses 218, a completely flat surface of the plug-in power supply 200 is achieved at the position of rest, said surface of the plug-in power supply having no projections which may get caught up with other objects. In addition, the primary contact pins 208 are so conceived that, at the position of rest, which is shown in FIGS. 2B and 2C, they are not in electric contact with the electronic circuit for voltage conversion in the interior of the housing. This contact is not established until the operating position has fully been reached (FIG. 2A).

Figure 4A:
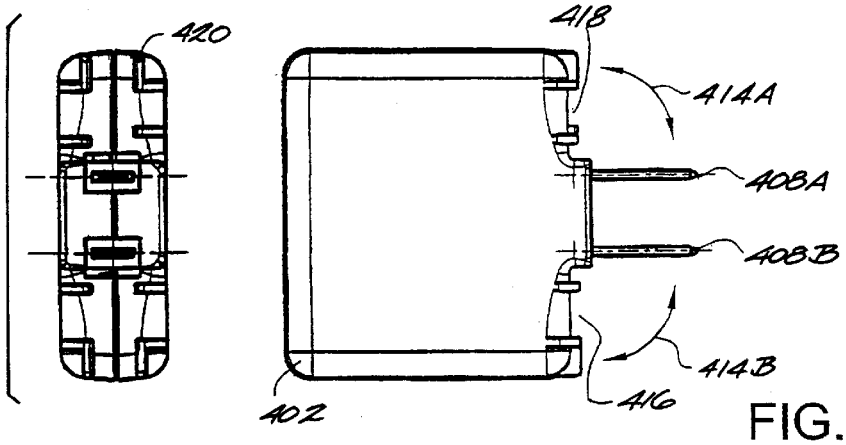
FIG. 4A illustrates an operating position of a plug-in power supply according to a third preferred embodiment.
Figure 4B:
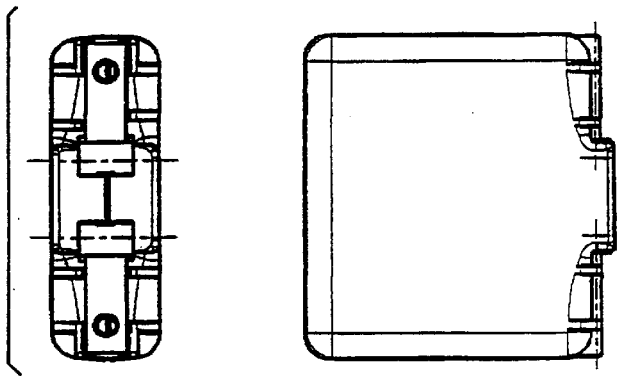
FIG. 4B illustrates a rest position of a plug-in power supply according to a third preferred embodiment.
Figure 4C:
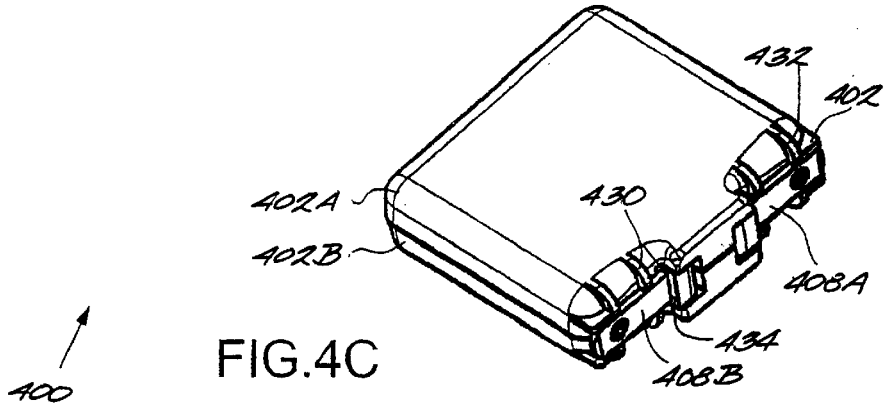
FIG. 4C illustrates a perspective view of a rest position of a plug-in power supply according to a third preferred embodiment.

A third preferred embodiment of a plug-in power supply 400 according to the present invention is shown in FIGS. 4A–4C. FIG. 4A shows two views of the plug-in power supply 400 in the operating position, whereas the views of FIGS. 4B and 4C show the rest position of the primary contact pins. In this embodiment, the primary contact pins 408A and 408B are arranged centrally on the lateral surface 416 of the housing 402. By swiveling the primary contact pins 408A, 408B in directions 414A and 414B, said pins are moved to the position of rest on the lateral surface 416. Projections 420 on both housing halves 402A and 402B define a reception means 418, which accommodates the contact pins 408A and 408B and which prevents them from getting caught up with an object during transport.

What is claimed is:

1. A plug-in power supply for converting a main supply voltage into an operating voltage, the plug-in power supply comprising:

a housing;

at least two primary contact pins, which are movable between an operating position and a resting position, the primary contact pins extend perpendicular to a first surface of the housing and operable to insert into a main supply socket in the operating position, one of the primary contact pins positioned on a different surface of the housing than the first surface in the resting position, wherein a geometric arrangement of the primary contact pins with respect to each other in their resting position differs from a geometric arrangement of the primary contact pins in their operating position.

2. A plug-in power supply according to claim 1, wherein at least one of the primary contact pins is swiveled from the operating position to the resting position.

3. A plug-in power supply according to claim 1, wherein at least one of the primary contact pins is movable from the operating position to the resting position by retracting the primary contact pin into the housing, the primary contact pin remaining perpendicular to the first surface.

4. A plug-in power supply according to claim 1, wherein at least one of the primary contact pins is operable to be locked in its operating position.

5. A plug-in power supply according to claim 1, wherein the housing includes a receptacle to receive at least one of the primary contact pins.

6. A plug-in power supply according to claim 1, wherein at least one of the primary contact pins is operable to be locked in its resting position.

7. A plug-in power supply according to claim 1, wherein the housing includes two halves which are connectable.

8. A plug-in power supply according to claim 1, wherein the housing includes a mechanical coupling device operable to move the primary contact pins.

9. A plug-in power supply according to claim 8, wherein the mechanical coupling device includes at least one gear.

10. A plug-in power supply according to claim 1, wherein the housing includes at least one rounded corner for retrieving at least one of the primary contact pins from its resting position.

11. A plug-in power supply for converting a main supply voltage into an operating voltage, the plug-in power supply comprising:

a housing; and at least two primary contact pins movable between an operating position and a resting position, the primary contact pins positioned perpendicular to a first surface of the housing in the operating position, the primary contact pins positioned on different surfaces of the housing with respect to each other in the resting position.

12. A plug-in power supply according to claim 11, wherein at least one of the primary contact pins is positioned on the first surface in the resting position.

13. A plug-in power supply according to claim 11, wherein at least one of the primary contact pins is swiveled from the operating position to the resting position.

14. A plug-in power supply according to claim 11, wherein at least one of the primary contact pins is movable from the operating position to the resting position by retracting the primary contact pin into the housing, the primary contact pin remaining perpendicular to the first surface.

15. A plug-in power supply according to claim 11, wherein at least one of the primary contact pins is operable to be locked in its operating position and resting position.

16. A plug-in power supply according to claim 11, wherein the housing includes a receptacle to receive at least one of the primary contact pins.

17. A plug-in power supply according to claim 16, wherein at least one of the primary contact pins positioned in the receptacle is in its resting position.

18. A plug-in power supply according to claim 11, wherein the housing includes at least one gear operable to move the primary contact pins.

19. A plug-in power supply according to claim 11, wherein the housing includes at least one rounded corner for retrieving at least one of the primary contact pins from its resting position.

* * * * *

UNITED STATES PATENT AND TRADEMARK OFFICE

CERTIFICATE OF CORRECTION

PATENT NO. : 6,585,530 B2 
DATED : July 1, 2003
INVENTOR(S) : Thomas Steiert and Andreas Kniesel It is certified that error appears in the above-identified patent and that said Letters Patent is hereby corrected as shown below:

Title page, Item [54] and Column 1, lines 1-3,
The title should read:
-- MINIATURIZED PLUG-IN POWER SUPPLY WITH MOVABLE PRIMARY CONTACT MEANS --

Title page,
Insert item:
-- [30] Foreign Application Priority Data
Jan. 22, 2001 (DE) .....101 02 713.3 --

Signed and Sealed this

Eighteenth Day of November, 2003

JAMES E. ROGAN
*Director of the United States Patent and Trademark Office*